US005133411A

United States Patent [19]

Gadelle et al.

[11] Patent Number: 5,133,411

[45] Date of Patent: Jul. 28, 1992

[54] METHOD AND DEVICE FOR STIMULATING A SUBTERRANEAN ZONE THROUGH THE CONTROLLED INJECTION OF A FLUID COMING FROM A NEIGHBOURING ZONE WHICH IS CONNECTED TO THE SUBTERRANEAN ZONE BY A DRAIN

[75] Inventors: Claude Gadelle, Rueil-Malmaison; Jacques Lessi, Maule; Gérard Renard, Rueil-Malmaison, all of France

[73] Assignee: Institut Francais du Petrole, Rueil-Malmaison, France

[21] Appl. No.: 636,271

[22] Filed: Dec. 31, 1990

[30] Foreign Application Priority Data

Dec. 29, 1989 [FR] France ..... 89 17481

[51] Int. Cl.[5] ..... E21B 43/25; E21B 21/00

[52] U.S. Cl. ..... 166/370; 166/50; 166/52; 175/61

[58] Field of Search ..... 166/50, 52, 129, 133, 166/142, 306, 265, 369, 370, 373, 374, 375; 175/61, 62

[56] References Cited

U.S. PATENT DOCUMENTS

| | | | |
|---|---|---|---|
| 2,736,381 | 2/1956 | Allen | 166/306 X |
| 3,258,069 | 6/1966 | Hottman | 166/265 X |
| 3,354,952 | 11/1967 | Engle | 166/306 X |
| 4,194,580 | 3/1980 | Messenger | 175/61 |
| 4,248,302 | 2/1981 | Churchman | 166/52 X |
| 4,262,747 | 4/1981 | Elliot et al. | 166/369 X |
| 4,519,463 | 5/1985 | Schuh | 175/61 |
| 4,714,117 | 12/1987 | Dech | 166/387 X |
| 4,807,704 | 2/1989 | Hsu et al. | 175/61 X |
| 4,945,994 | 8/1990 | Stagg | 166/369 |
| 5,016,710 | 5/1991 | Renard et al. | 166/52 X |

*Primary Examiner*—George A. Suchfield
*Attorney, Agent, or Firm*—Antonelli, Terry, Stout & Kraus

[57] ABSTRACT

A subterranean zone and a neighbouring zone are, respectively, for example, a petroliferous deposit and an underlying aquiferous nappe at a fluid pressure higher than that prevailing in the subterranean zone. A method of stimulating production of effluent from the subterranean zone involves drilling at least one deflected drain (preferably nearly or totally horizontal) through the petroliferous zone, the neighbouring zone and an intermediate layer which separates the petroliferous zone from the aquiferous nappe. The intermediate layer is, for example, slightly permeable because of the presence of heavy and viscous hydrocarbon products. The drain is equipped with a pipe fitted with openings at the subterranean zone and at the neighbouring zone and with packer devices selectively positioned in the pipe. A controlled opening of one packer device during production allows injection of water under pressure into the subterranean zone in order to promote production of effluent therefrom.

9 Claims, 3 Drawing Sheets

PL.1.2

METHOD AND DEVICE FOR STIMULATING A SUBTERRANEAN ZONE THROUGH THE CONTROLLED INJECTION OF A FLUID COMING FROM A NEIGHBOURING ZONE WHICH IS CONNECTED TO THE SUBTERRANEAN ZONE BY A DRAIN

BACKGROUND OF THE INVENTION

The present invention relates to a method for stimulating production of a subterranean zone through the controlled injection of fluid under pressure from a neighbouring zone which is linked to the subterranean zone by means of a deflected drain running through a slightly permeable intermediate layer. What is called a deflected drain throughout the text hereinafter is any wellbore at least part of which is horizontal or relatively slightly inclined in relation to the horizontal.

The method according to the invention more particularly stimulates the production of a petroliferous zone separated from an underlying zone containing a fluid under pressure, such as an aquiferous zone or possibly another petroliferous zone.

Various techniques known by specialists are utilized for stimulating the production of petroliferous zones. One of them essentially consists in injecting a fluid under pressure into the formation in production, capable of draining the oil stagnating in the rocks because of its viscosity. The fluid used is, for example, water under pressure injected by drains bored through the formation. It can also be water existing in depth, in the basin in production itself, in the form of an underlying aquiferous nappe.

In certain types of basins, the aquiferous nappe lies under the petroliferous zone and is separated from the zone by a layer which is slightly permeable notably because of the presence of heavy and very viscous hydrocarbon products (tarmat). It is envisaged to utilize this underlying water to stimulate the production of a petroliferous zone. The water nappe being located at a depth greater than that of the petroliferous zone, its pressure is higher. The at least partial depletion of the zone in production leads to the increasing of the overpressure of the water in the underlying nappe in relation to the fluids in the zone above. The possible injection into the petroliferous formation of this overpressure water should act to drain the oil and to favour the production.

The attempts to stimulate production zones topping aquiferous nappes have not yet produced the expected results. Vertical wells or drains have been bored through the petroliferous zone in order to make the petroliferous deposit communicate with the water nappe. But it has been noticed that this type of wells essentially produces water. This negative result can be explained by the fact that the water in the nappe tends to directly escape towards the surface through the well that has been created, instead of entering the petroliferous formation. This phenomenon persists if a closure device is taken down into the well, because the water of the nappe tends to flow round it through the surrounding formations. A possible closure of the well at the surface causes a certain diffusion of the water in the petroliferous zone. But the results are not very significant because the volume of the deposit penetrated by the water remains relatively low.

SUMMARY OF THE INVENTION

The method according to the invention stimulates the production of a subterranean zone through the controlled injection of a fluid coming from a neighbouring zone separated from the subterranean zone by a slightly permeable intermediate layer, by avoiding the drawbacks mentioned above.

The method of the invention is characterized by the drilling of at least one deflected drain through the subterranean zone, the intermediate layer and the neighbouring zone, and by subsequently connecting, by means of the drain, the neighbouring zone and the subterranean zone in order to favour the draining of the subterranean zone by said fluid under pressure.

The method comprises for example the drilling of a deflected drain through a petroliferous zone, an intermediate zone and an aquiferous zone.

The method also comprises for example the drilling of a deflected drain through a petroliferous zone, an intermediate layer and an underlying second petroliferous zone.

The drain is, for example, drilled through a slightly permeable intermediate layer. It can also be drilled through a non-petroliferous intermediate layer.

According to an implementing example, the subterranean zone communicates with the surface by at least one vertical production well whose position in relation to the deflected drain is selected for optimizing the production.

According to another implementing example, the subterranean zone communicates with the surface by at least one deflected production well whose position in relation to the deflected drain is selected for optimizing the production.

An advantageous delivery is obtained by closing said drain in the deflected part drilled through the subterranean zone, at least part of the drain constituting a production well.

Two functions can therefore be fulfilled with a single drain, i.e. by subsequently connecting the formation with the stimulation fluid and gathering of the oil effluents released by the stimulation, at the level where the drain runs through the formation.

The device for carrying out the method according to the invention is characterized by a pipe arranged in a deflected drain linking the subterranean zone to the neighbouring zone, said pipe being fitted with openings respectively at the level of each on of said zones, a first preventer stack or packer means being arranged in the pipe at the level of the intermediate layer and a second packer means stack for confining said pipe.

The implementing procedure where the drain is used for gathering the production induced by stimulation utilizes, for example, a pipe comprising in a part crossing the subterranean zone another portion of length provided with openings, this other portion being laterally shifted in relation to the one portion in the subterranean zone, and a packer means being arranged in the pipe between the two portions of length of the subterranean zone.

Injecting a fluid under pressure into a subterranean zone such as an oil deposit whose inner pressure is lowered because of the production, through the controlled opening of the inclined drain, properly confined in order to prevent the fluid from escaping towards the surface, has the effect of pushing the oil towards the producing wells. The use of a deflected drain (horizontal or slightly inclined towards the horizontal) allows to increase the volume of the zone invaded by the injected fluid. When the neighbouring zone is an active aquiferous zone, i.e. permanently resupplied by water influxes, the injection pressure undergoes no substantial drop throughout the draining phase. The obtained effect lasts longer.

BRIEF DESCRIPTION OF THE DRAWINGS

Other features and advantages of the method according to the invention will be clear from the following description of an embodiment given by way of non-limitative examples, with reference to the accompanying drawings in which.

DESCRIPTION OF THE PREFERRED EMBODIMENTS

Figure 1:
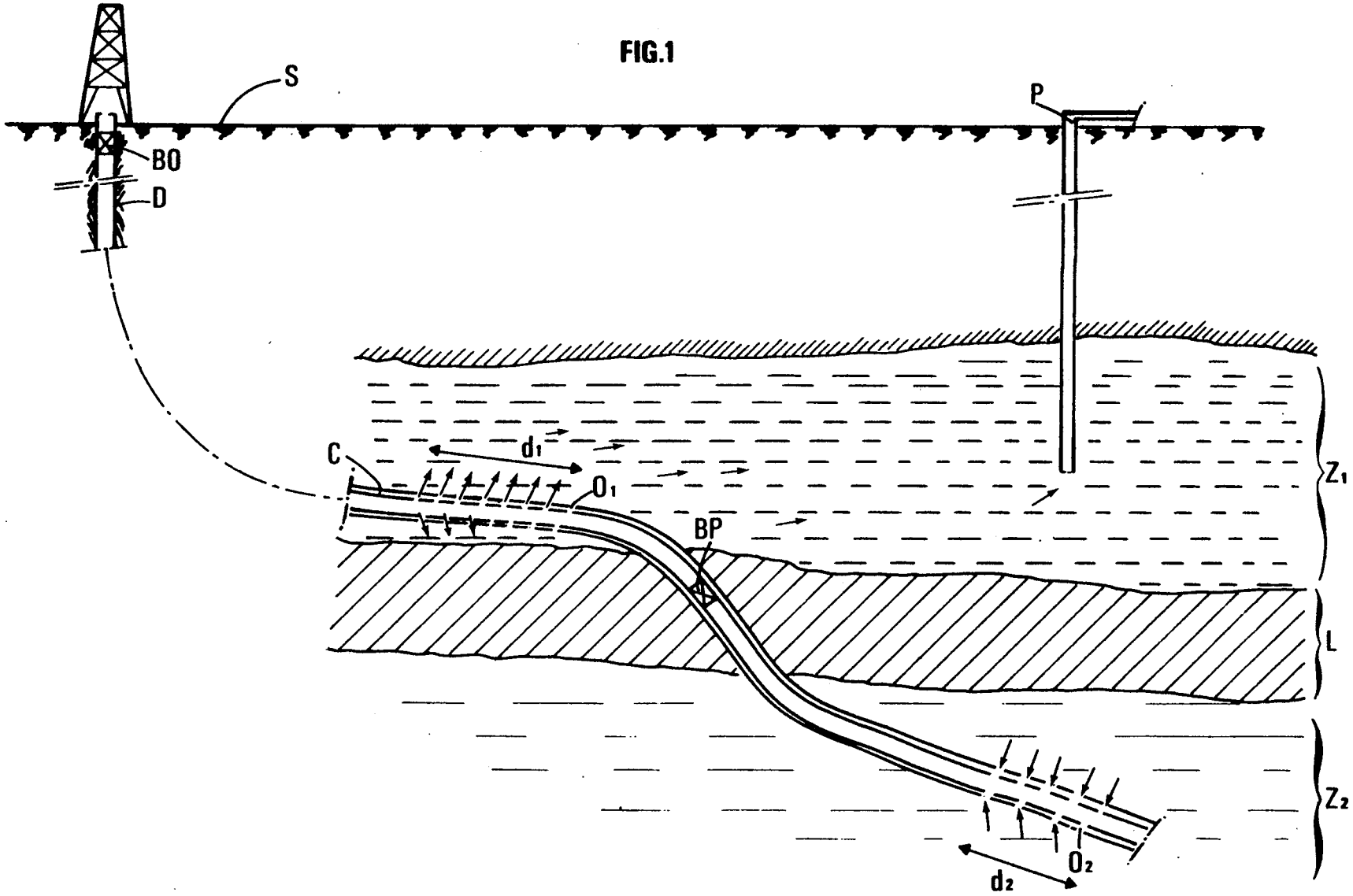
FIG. 1 diagrammatically shows a section of a petroliferous production zone topping a zone containing a fluid under pressure, such as an aquiferous zone, and a first embodiment of the method according to the invention.
Figure 3:
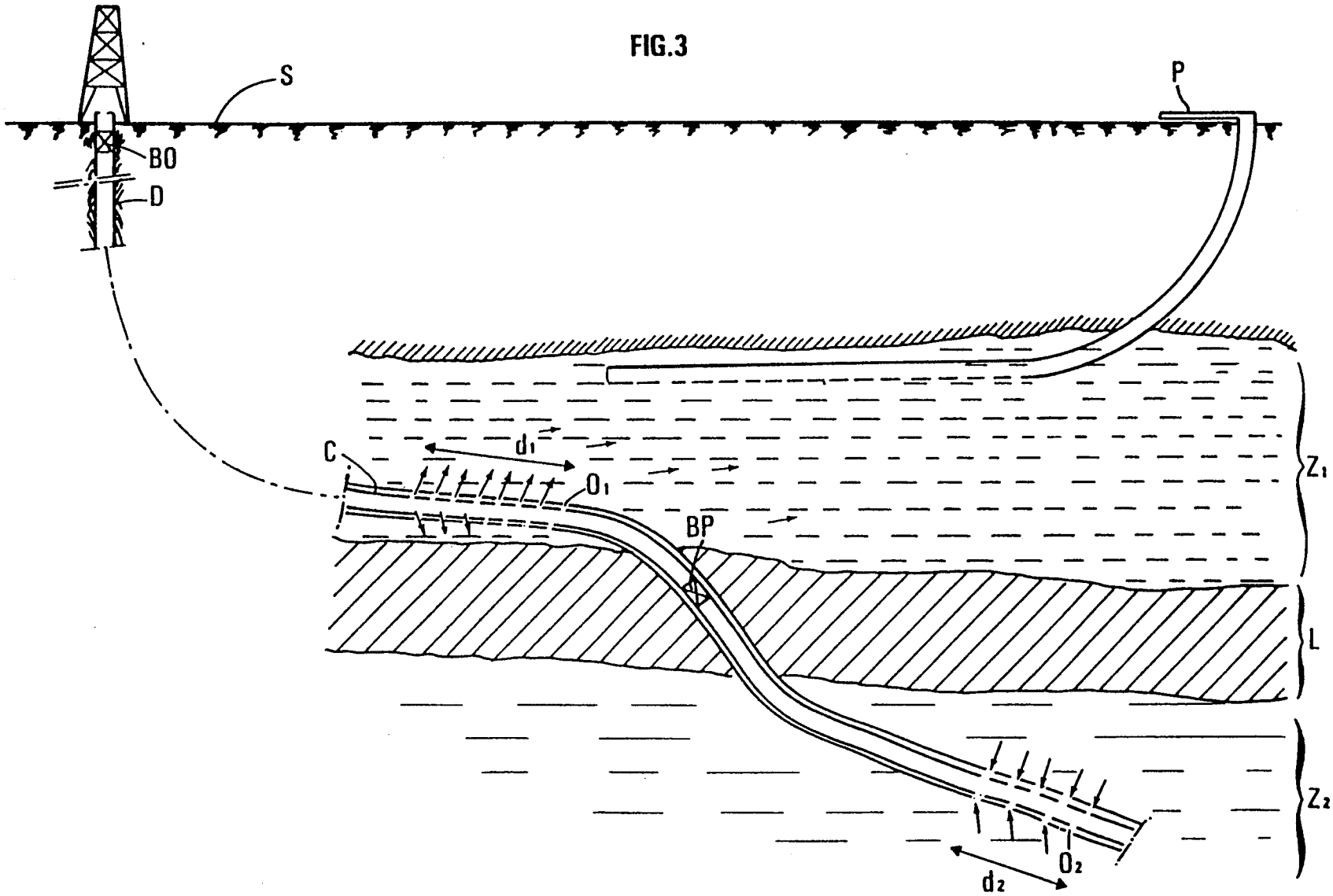
FIG. 3 diagrammatically shows a section of two zones arranged similar to FIG. 1, wherein a deflected well is used as a production well.

The petroliferous zone Z1 produces oil through at least one production well P. This well may be vertical as shown on FIG. 1 or, according to FIG. 3, horizontal. In certain basins, a neighbouring zone containing a fluid under pressure lies below petroliferous zone Z1 and is separated from it by a slightly permeable layer L. The pressure of this fluid is higher than the pressure prevailing in production zone Z1 because the neighbouring zone lies deeper, but above all because of the partial depletion of the petroliferous zone resulting from its development. This fluid may be water or an oil-bearing fluid. When the neighbouring zone is aquiferous, it is generally of the active type, i.e. it is supplied by external water influxes and the pressure which prevails within remains substantially constant. The intermediate layer L can be for example a zone made substantially impermeable because of the presence of very heavy and viscous hydrocarbon products. This layer L can also be of a non-petroliferous type.

The method according to the invention comprises drilling from the surface S of a drain D deflected in order to cross the petroliferous zone Z1 horizontally or following a slightly inclined angle in relation to the horizontal. The drilling direction is inflected so that the drain runs through the slightly permeable layer L and penetrates the neighbouring zone Z2. When the drain is drilled, it is fitted with a casing C on its total length. Packer means of a well-known type tightly close the annular space between the casing and the drain at the level of layer L, for example. On at least one portion d1 of its length, where it runs through the production zone, casing C is fitted with lateral openings 01 connecting the formations crossed with the inside of casing C. In the same way, at least a portion d2 of casing C in a part drilled through neighbouring zone Z2 is also fitted with lateral openings 02. Once casing C is installed, an closure device or packer means BP cf the type known by specialists as a "bridge plug" is taken down into the drain right to the intermediate layer L. A second packer means BO is also installed in casing C next to the surface, for example, in order to confine the latter and to isolate it from the external medium. The first packer means BP is operated from the surface, by means of a control device that is not shown, in order to close any communication between the two zones Z1 and Z2.

The drain can be drilled at any moment, before the bringing in of the petroliferous zone Z1 or possibly during the period of production.

During this period of production, when it appears that zone Z1 requires a stimulation, the opening of preventer stack BP is released from the surface installation in order to set up a communication between the two zones Z1 and Z2. The fluid, in this case the water of zone Z2, being at a higher pressure and the drain being confined by the second packer means BO, the water enters zone Z1 through the openings 01 of casing C and drives away the hydrocarbons accumulated in the formation.

The position of the vertical and/or horizontal production wells in relation to the deflected drains or conversely of the drains in relation to the wells, according to the order following which they have been drilled, is selected according to the known procedures in order to optimize the oil production.

Figure 2:
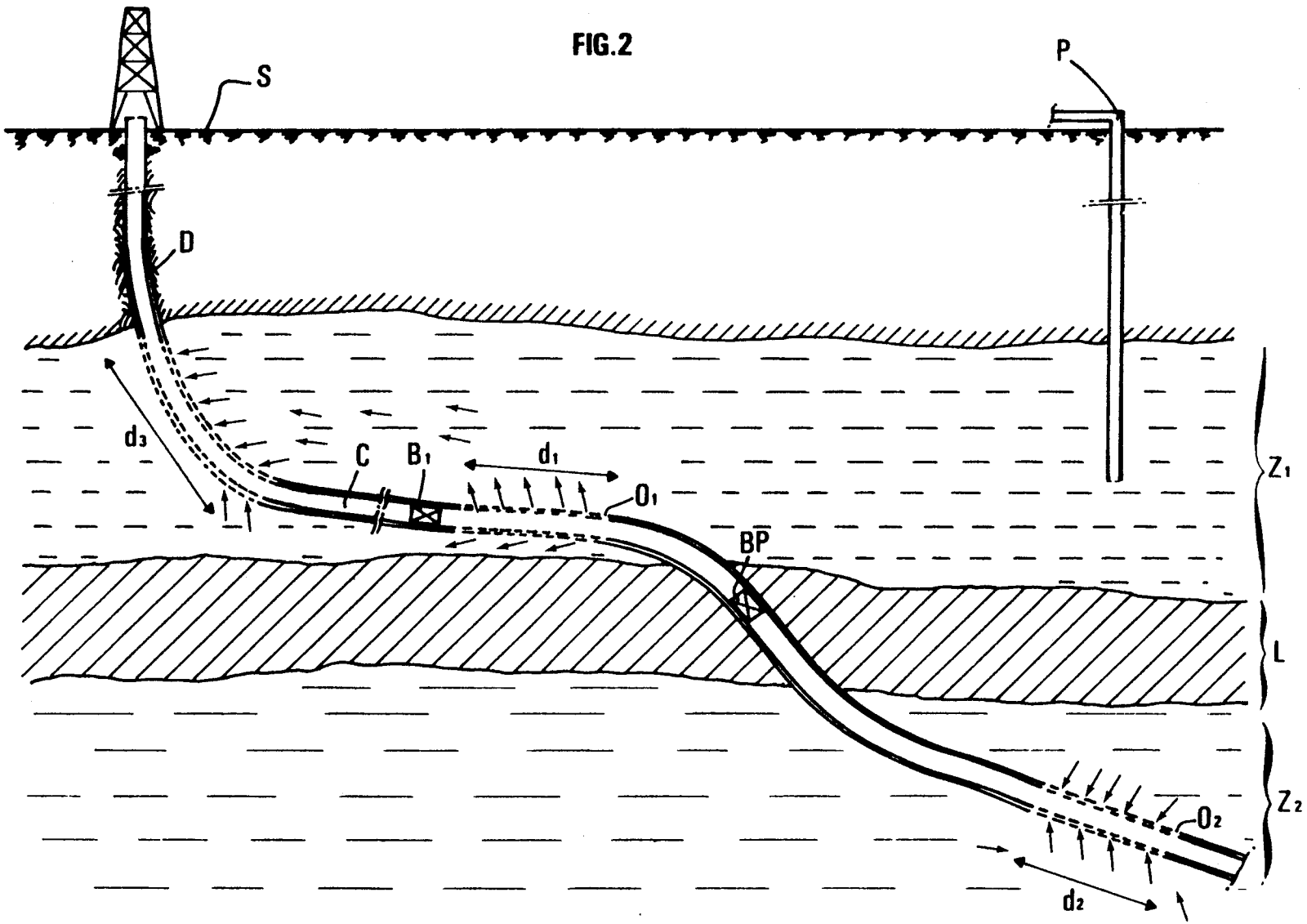
FIG. 2 diagrammatically shows the same section with a second embodiment procedure of the method.

According to the embodiment procedure of FIG. 2, drain D is arranged in order to be able to be used as a production well. To that effect, casing C is fitted in its deflected part which crosses the production zone with another portion of length d3 fitted with lateral openings 03. According to the case, this other casing portion d3 is more or less distant from portion d1 which the water coming from zone Z2 can come through, and laterally shifted in relation to the latter. An obturation device B1, the closing of which can be released from the surface installation in the same way as for obturation device BP, is arranged between the two portions d1 and d3, both open in zone Z1.

During the period of production, when a stimulation of the production is necessary, obturation device BP is opened and device B1 is closed in order to confine drain D. The water coming from the underlying zone Z2 enters the production zone Z1 through the openings in part d1 and drives the oil away towards part d3 of casing C open on the external medium.

The method according to the invention therefore allows to utilize at best the fluid under high pressure which is available in depth in order to stimulate the oil production.

We claim:

1. A method for stimulating the production of an effluent out of a subterranean zone separated from a neighbouring zone containing a fluid under pressure by an intermediate layer through controlled injection of the fluid into the subterranean zone, said method comprising:

drilling at least one deflected drain through the subterranean zone, the intermediate layer and the neighbouring zone, a portion of the drain extending through the subterranean zone being greatly deflected in relation to the vertical on at least part of its length; and when stimulation of said subterranean zone is necessary, allowing the fluid under pressure from said neighbouring zone to penetrate into said subterranean zone through the drain, thereby favoring said production of said effluent out of said subterranean zone.

2. A method as claimed in claim 1, wherein the deflected drain is drilled through a subterranean zone comprising a petroliferous zone, an intermediate layer and a neighbouring zone comprising an aquiferous zone.

3. A method as claimed in claim 1, wherein the deflected drain is drilled through a subterranean zone comprising a first petroliferous zone, an intermediate layer and a neighbouring zone comprising an underlying second petroliferous zone.

4. A method as claimed in claim 1, wherein the drain is drilled through an intermediate layer comprising an impervious or slightly permeable layer.

5. A method as claimed in claim 1, wherein the deflected drain is drilled through an intermediate layer comprising a non-petroliferous layer.

6. A method as claimed in any one of claims 1 to 5, wherein the subterranean zone communicates with the surface through at least one vertical production well, the deflected drain being positioned with respect to said vertical production well to optimize production of the effluent.

7. A method as claimed in claim 4 or claim 5, wherein the subterranean zone communicates with the surface through at least one deflected production well, said deflected drain being positioned with respect to the deflected production wells to optimize production of the effluent.

8. A method as claimed in any one of the claims 1 to 5, wherein said drain is closed in a deflected part thereof drilled through the subterranean zone, at least a part of said drain being used as a production well.

9. A well completion arrangement for stimulating the production of effluent from a subterranean zone separated from an adjacent zone containing a fluid at a pressure higher than that of said subterranean zone, by an impervious or slightly permeable intermediate layer, said arrangement comprising a tube arranged in a deflected drain drilled through said subterranean zone, said intermediate layer and said adjacent zone; said tube comprising a first portion of length provided with first openings in a part thereof extending through said subterranean zone, a second portion of length provided with second openings in a part thereof extending through said adjacent zone, and a third portion of length provided with openings, said third portion being laterally shifted in relation to said first portion and also extending through said subterranean zone; a first packer means arranged in the part of the pipe extending through said intermediate layer and a second packer means arranged in the pipe between said first portion and said third portion.

* * * * *